US007711299B2

(12) United States Patent
Furukawa et al.

(10) Patent No.: US 7,711,299 B2
(45) Date of Patent: May 4, 2010

(54) COLOR IMAGE FORMING APPARATUS WITH DISCHARGE MEMBER

(75) Inventors: Toshio Furukawa, Nagoya (JP); Kensuke Miyahara, Hekinan (JP); Katsuyuki Yokoi, Iwakura (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 212 days.

(21) Appl. No.: 11/958,961

(22) Filed: Dec. 18, 2007

(65) Prior Publication Data

US 2008/0145114 A1 Jun. 19, 2008

(30) Foreign Application Priority Data

Dec. 18, 2006 (JP) ..... 2006-340073

(51) Int. Cl.
*G03G 15/01* (2006.01)
*G03G 15/16* (2006.01)

(52) U.S. Cl. ..... 399/303; 399/101; 399/299

(58) Field of Classification Search ..... 399/101, 399/299, 302, 303, 308, 312; 361/214; 474/90
See application file for complete search history.

(56) References Cited

U.S. PATENT DOCUMENTS 6,029,022 A * 2/2000 Takase ..... 399/66
6,134,415 A * 10/2000 Iwakura et al. ..... 399/299
6,498,913 B1 * 12/2002 Tooker et al. ..... 399/90
7,302,211 B2 * 11/2007 Deguchi et al. ..... 399/171
7,391,988 B2 * 6/2008 Igarashi et al. ..... 399/101
2001/0028817 A1 * 10/2001 Tamura et al. ..... 399/297

FOREIGN PATENT DOCUMENTS

JP 08036288 A * 2/1996
JP 2001-109338 4/2001
JP 2002278313 A * 9/2002
JP 2004004186 A * 1/2004

* cited by examiner

*Primary Examiner*—Robert Beatty
(74) *Attorney, Agent, or Firm*—Banner & Witcoff, Ltd

(57) ABSTRACT

A color image forming apparatus is described. The color image forming apparatus may includes: a belt that travels in a prescribed direction; a plurality of image carriers arranged in parallel in the prescribed direction, and opposed to the belt and carrying developing agent images of different colors respectively; a backup roller arranged in opposed relation to the belt; a cleaning roller arranged in opposed relation to the backup roller with the belt sandwiched therebetween, and adsorbing an adherent to the belt by a potential difference produced between the backup roller and the cleaning roller; and a discharge member opposed to the belt between a position more downstream in the prescribed direction than a position where the cleaning roller is opposed to the belt and a position more upstream in the prescribed direction than a position where the image carrier arranged on the most upstream side in the prescribed direction is opposed to the belt, for discharging the belt.

8 Claims, 5 Drawing Sheets

( a )

( b )

( a )

( b )

COLOR IMAGE FORMING APPARATUS WITH DISCHARGE MEMBER

CROSS REFERENCE TO RELATED APPLICATION

This application claims priority to Japanese Patent Application No. 2006-340073 filed on Dec. 18, 2006, the disclosure of which is hereby incorporated by reference into the present application.

TECHNICAL FIELD

The present invention relates to a color image forming apparatus, such as a color laser printer.

BACKGROUND

Conventionally, in color image forming apparatuses, such as a color laser printer, a method of transferring a toner image formed on a surface of a photosensitive drum to a sheet transported by a sheet transport belt, and a method of once transferring a toner image formed on a surface of a photosensitive drum to an intermediate transfer belt and then transferring it to a sheet therefrom have been known.

A belt, such as the sheet transport belt and the intermediate transfer belt, is wound around a plurality of rollers, and arranged so as to come in contact with the surface of the photosensitive drum. Therefore, the contact of the belt with the photosensitive drum causes a toner to be shifted and adhered to the surface of the belt, and the contact of the belt with a sheet causes a sheet dust to be adhered thereon.

A color image forming apparatus including such a belt is provided with a cleaning unit for removing the adherent on the surface of the belt. As the cleaning unit, one that makes a cleaning blade or a fur brush contact with the surface of the belt and then physically removes the adherent thereon has been known.

Another structure of the cleaning unit can be considered in which a cleaning roller is arranged in contact with the surface of the belt and a bias is applied to the cleaning roller, so that a potential difference is produced between the cleaning roller and the belt, whereby an electrostatic force causes the adherent on the surface of the belt to be shifted to the cleaning roller.

However, under the effect of the bias applied to the cleaning roller, the belt is charged, and due to the charging (uneven charging), a white patch (phenomenon in which an image is not locally printed) may appear in an image formed on a sheet.

SUMMARY

One aspect of the present invention may provide a color image forming apparatus capable of preventing a white patch resulting from uneven charging of a belt, while advantageously removing an adherent to the belt with a cleaning roller.

The same or different aspect of the present invention may provide a color image forming apparatus including: a belt that travels in a prescribed direction; a plurality of image carriers arranged in parallel in the prescribed direction, and opposed to the belt and carrying developing agent images of different colors respectively; a backup roller arranged in opposed relation to the belt; a cleaning roller arranged in opposed relation to the backup roller with the belt sandwiched therebetween, and adsorbing an adherent to the belt by a potential difference produced between the backup roller and the cleaning roller; and a discharge member opposed to the belt between a position more downstream in the prescribed direction than a position where the cleaning roller is opposed to the belt and a position more upstream in the prescribed direction than a position where the image carrier arranged on the most upstream side in the prescribed direction is opposed to the belt, for discharging the belt.

DETAILED DESCRIPTION

Figure 1:
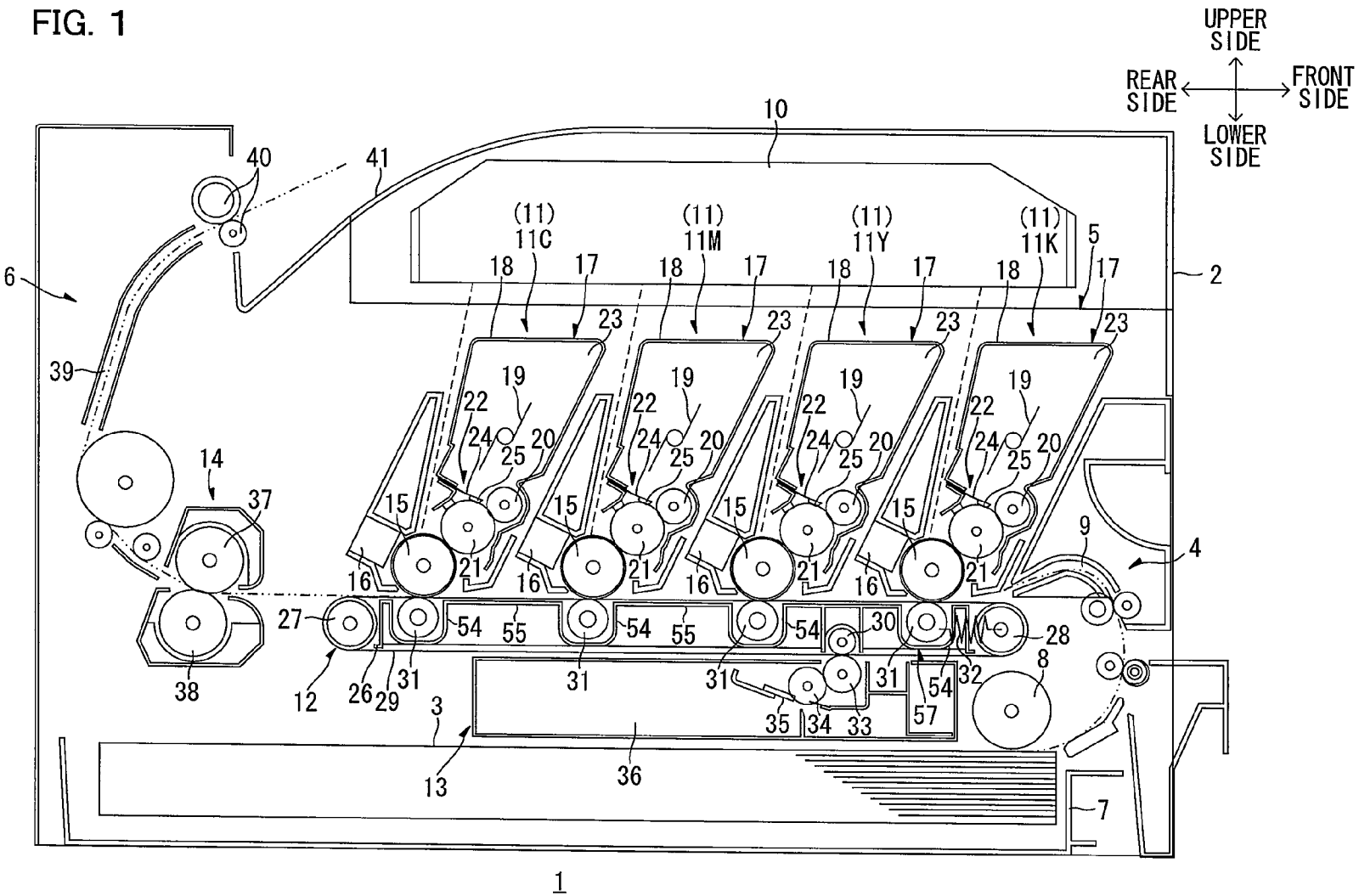
FIG. 1 is a side sectional view of a color laser printer as an example of a color image forming apparatus of one or more aspects of the present invention.

The embodiments of the present invention will be described below while referring to the drawings.

First Embodiment

1. General Structure of Color Laser Printer

FIG. 1 is a side sectional view of a color laser printer as an example of a color image forming apparatus of one or more aspects of the present invention.

The color laser printer 1 is of a tandem type adopting a direct transfer method. In a main body casing 2 having a box-like shape, a sheet feeding section 4 for feeding a sheet 3, an image forming section 5 for forming an image on the sheet 3, and a sheet ejecting section 6 for ejecting the sheet 3 formed with the image are arranged.

In the following description, the right side of FIG. 1 is referred to as the front side, while the left side of FIG. 1 is referred to as the rear side. A left and right direction is determined when the color laser printer 1 is viewed from the front side.

(1) Sheet Feeding Section

The sheet feeding section 4 includes a sheet feeding tray 7 for accommodating sheets 3 in a stacked state and a sheet feeding roller 8 for sending out the sheets 3 in the sheet feeding tray 7 on a sheet-by-sheet basis. The sheet 3 thus sent out from the sheet feeding tray 7 is transported toward the image forming section 5 on a sheet transport path 9.

(2) Image Forming Section

The image forming section 5 includes a scanning section 10, a processing section 11, a transferring unit 12, a cleaning unit 13, and a fixing section 14.

(2-1) Scanning Section

The scanning section 10 is arranged in the upper portion of the main body casing 2. The scanning section 10 includes optical members such as a laser, a mirror, and a lens, and emits four laser beams toward four photosensitive drums 15 described later. As indicated by a broken line in FIG. 1, each of the laser beams is irradiated onto each of the surfaces of the corresponding photosensitive drums 15.

(2-2) Processing Section

A plurality of the processing sections 11 are provided corresponding to toners of respective colors. Specifically, four processing sections 11 includes a black, yellow, magenta, and cyan processing sections 11K, 11Y, 11M, and 11C. These four processing sections 11 are arranged in parallel so as to be spaced away from one another from the front side to the rear side in the order of the black processing section 11K, the yellow processing section 11Y, the magenta processing section 11M, and the cyan processing section 11C.

Each of the processing sections 11 includes the photosensitive drum 15 as an example of an image carrier. The photosensitive drum 15 has a cylindrical shape, and its outermost surface layer is formed of a positively chargeable photosensitive layer of polycarbonate or the like.

A scorotron charger 16 and a developer cartridge 17 are arranged around the photosensitive drum 15.

The developer cartridge 17 includes an agitator 19, a feed roller 20, a developing roller 21 and a layer-thickness regulating blade 22 in a casing 18.

The casing 18 is formed in a box-like shape with its rear lower end portion opened. The upper portion in the casing 18 is a toner accommodating chamber 23. The toner accommodating chamber 23 accommodates a toner of each color. Specifically, a yellow toner, a magenta toner, a cyan toner, and a black toner are accommodated in the corresponding toner accommodating chambers 23 of the developer cartridges 17 of the yellow processing section 11Y, the magenta processing section 11M, the cyan processing section 11C, and the black processing section 11K, respectively. As the toner of each color, a positively chargeable, non-magnetic, single-component polymerized toner is used, in which coloring agent of black, yellow, magenta, or cyan is mixed corresponding to each color.

The agitator 19 is rotatably provided in the toner accommodating chamber 23.

The feed roller 20 is arranged in the lower portion of the toner accommodating chamber 23. The feed roller 20 has a structure in which a metal roller shaft is covered with a roller portion made of an electrically-conductive sponge member.

The developing roller 21 is provided obliquely rearward below the feed roller 20. The developing roller 21 has a structure in which a metal developing roller shaft is covered with a rubber roller made of an electrically-conductive rubber. A part of circumferential surface of the developing roller 21 is exposed from the casing 18 and is in pressure contact with the photosensitive drum 15 from the front side.

The layer-thickness regulating blade 22 includes a leaf-spring member 24 one end of which is fixed to the casing 18, and a pressure contact rubber 25 provided at the tip end portion (distal-end portion) of the leaf-spring member 24. The layer-thickness regulating blade 22 is provided so that the pressure contact rubber 25 is brought into pressure contact with the circumferential surface of the developing roller 21 from above.

In each of the developer cartridges 17, a toner in the toner accommodating chamber 23 is supplied to the feed roller 20 while being agitated, by rotation of the agitator 19. During an image forming operation (during development), the developing roller 21 and the feed roller 20 are rotationally driven in the reverse direction (counterclockwise in the figure) to the photosensitive drum 15 so as to rub against each other at the roller portions thereof. Further, a developing bias is supplied to the developing roller 21. Thus, a toner positively charged is carried on the circumferential surface of the developing roller 21. Along with the rotation of the developing roller 21, the toner thus carried on the circumferential surface of the developing roller 21 enters between the pressure contact rubber 25 of the layer-thickness regulating blade 22 and the developing roller 21, thereby forming a thin layer having a uniform thickness.

On the other hand, the photosensitive drum 15 is rotationally driven, and along with this rotation, the surface of the photosensitive drum 15 is uniformly positively charged by corona discharge from the scorotron charger 16. Then, as the portion thus positively charged is irradiated with the laser beams from the scanning section 10, an electrostatic latent image of each color corresponding to the image to be formed on the sheet 3 is formed on the surface of the photosensitive drum 15. When the electrostatic latent image is opposed to the surface of the developing roller 21 by rotation of the photosensitive drum 15, the toner carried on the developing roller 21 is shifted to a portion having a lower potential due to the exposure to the laser beams on the surface of the photosensitive drum 15. Thus, the electrostatic latent image on the photosensitive drum 15 is transformed into a visible image, whereby a toner image corresponding to each color is carried on the surface of the photosensitive drum 15.

(2-3) Transferring Unit

The transferring unit 12 is arranged below the four processing sections 11. The transferring unit 12 includes a transferring unit frame 26 as an example of a frame, a driving roller 27 as an example of a second belt roller, a driven roller 28 as an example of a first belt roller, a transport belt 29 as an example of a belt, a backup roller 30, and four transfer rollers 31.

The transferring unit frame 26 is anteroposteriorly extended. The front end portion of the transferring unit frame 26 is positioned forward of the photosensitive drum 15 of the black processing section 11K, while the rear end portion of the transferring unit frame 26 is positioned rearward of the photosensitive drum 15 of the cyan processing section 11C.

The driving roller 27 has a structure in which a shaft having a shape of a round tube made of aluminum or stainless steel is covered with a roller portion made of rubber or the like. The driving roller 27 is extended in the right and left direction, with both the end portions thereof supported on the rear end portion of the transferring unit frame 26.

The driven roller 28 is a roller having a shape of a round tube made of aluminum or a stainless steel. The circumferential surface of the driven roller 28 (roller portion) is plated in order to prevent wear due to contact with the transport belt 29. The driven roller 28 is extended in the right and left direction, with both the end portions thereof supported on the front end portion of the transferring unit frame 26. Further, the driven roller 28 is attached to the transferring unit frame 26 with an anteroposterior play. The driven roller 28 is always urged to a direction spaced away from the driving roller 27, that is, forward, by a spring 32 provided on the transferring unit frame 26. The driven roller 28 is grounded via the transferring unit frame 26.

The transport belt 29 is wound between the driving roller 27 and the driven roller 28. The transport belt 29 is made of resins, such as polycarbonate, and has a resistance value of $1.0\times10^{10}$ Ω·cm or more. A moderate tension is given to the transport belt 29 by urging the driven roller 28 in the direction spaced away from the driving roller 27.

The backup roller 30 is made of an electrically-conductive material, such as metal. The backup roller 30 is extended in the right and left direction, with both the end portions thereof supported on the transferring unit frame 26. The backup roller 30 is arranged in a space surrounded by the transport belt 29, and is opposed to a primary cleaning roller 33 described later of the cleaning unit 13 while sandwiching the transport belt 29 therebetween.

The four transfer rollers 31 are arranged in the space surrounded by the transport belt 29, and are opposed to the respective photosensitive drums 15 while sandwiching the transport belt 29 therebetween. Each of the transfer rollers 31 has a structure in which a metal roller shaft is covered with a roller portion made of an elastic member, such as an electrically-conductive rubber material. The respective transfer rollers 31 are in parallel to one another while being extended in the width direction, and both the end portions thereof are supported on the transferring unit frame 26. During an image forming operation, a transfer bias is applied to each of the transfer rollers 31.

When the driving roller 27 is rotationally driven in the reverse direction (clockwise in the figure) to the rotation direction of the photosensitive drum 15 by a driving force from a motor (not shown) provided in the main body casing 2, the transport belt 29 circumferentially travels in the same direction as the rotation direction of the driving roller 27. Specifically, the driving force from the motor causes the transport belt 29 to circumferentially travel so that the upper portion (portion extending between the upper circumferential end of the driving roller 27 and that of the driven roller 28) of the transport belt 29 moves rearward. Along with the travel of the transport belt 29, the driven roller 28 is driven and rotates in the same direction as the driving roller 27.

The sheet 3 transported from the sheet feeding section 4 to the image forming section 5 is fed onto the transport belt 29. Then, as the transport belt 29 circumferentially travels, the sheet 3 thus fed is transported so as to sequentially pass the spaces between the respective photosensitive drums 15 and the transport belt 29. During such transportation, the toner images carried on the respective photosensitive drums 15 are overlapped in color and transferred onto the sheet 3 by the transfer bias applied to each of the transfer rollers 31. Thus, a color image is formed on the sheet 3. At this time, each of the transfer rollers 31 is driven to rotate in the same direction as the circumferentially moving direction of the transport belt 29 at a corresponding transfer position where it is opposed to and contacts the transport belt 29.

(2-4) Cleaning Unit

The cleaning unit 13 is arranged between the transferring unit 12 and the sheet feeding tray 7 of the sheet feeding section 4. The cleaning unit 13 includes the primary cleaning roller 33 as an example of a cleaning roller, a secondary cleaning roller 34, a urethane blade 35, and a receiving section 36.

The primary cleaning roller 33 is arranged so as to extend in the right and left direction, and the circumferential surface thereof is in contact with the surface (under surface) of the lower portion (portion extending between the lower circumferential end of the driving roller 27 and that of the driven roller 28) of the transport belt 29. Further, the primary cleaning roller 33 is opposed to the backup roller 30 while sandwiching the upper portion of the transport belt 29 therebetween. The primary cleaning roller 33 is formed by covering a shaft made of an electrically-conductive material (e.g., a Ni (nickel)-plated iron material or a stainless steel material) with a foam material of silicone. The primary cleaning roller 33 is rotationally driven in the reverse direction (counterclockwise in the figure) to the moving direction of the transport belt 29 at a position where it is in contact with the transport belt 29.

The secondary cleaning roller 34 is arranged so as to extend in parallel to the primary cleaning roller 33, and is in contact with the circumferential surface of the primary cleaning roller 33. The secondary cleaning roller 34 is comprised of a bar-like member (shaft) made of an electrically-conductive material, such as iron material.

During cleaning process for removing an adherent such as a toner or a sheet dust adhered to a surface of the transport belt 29, appropriate cleaning biases are applied to the primary cleaning roller 33 and the secondary cleaning roller 34 respectively. On the other hand, the backup roller 30 is grounded. Thus, potential differences are respectively produced between the backup roller 30 (transport belt 29) and the primary cleaning roller 33, and between the primary cleaning roller 33 and the secondary cleaning roller 34. The potential difference between the backup roller 30 and the primary cleaning roller 33 causes the adherent on the surface of the transport belt 29 to be shifted to the primary cleaning roller 33. The potential difference between the primary cleaning roller 33 and the secondary cleaning roller 34 then causes the adherent thus shifted to the primary cleaning roller 33 to be shifted to the secondary cleaning roller 34. The adherent thus shifted to the secondary cleaning roller 34 is scraped off by the urethane blade 35, thereby falling off from the secondary cleaning roller 34. As a result, the adherent thus fallen is stored in the receiving section 36.

(2-5) Fixing Section

The fixing section 14 is arranged behind the transferring unit 12. The fixing section 14 includes a heating roller 37 and a pressure roller 38. The pressure roller 38 is in pressure contact with the heating roller 37 from below. The sheet 3 transported by the transport belt 29 is sent between the heating roller 37 and the pressure roller 38. While the sheet 3 passes between the heating roller 37 and the pressure roller 38, the toner image transferred on the sheet 3 is fixed thereto by heat and pressure.

(3) Sheet Ejecting Section

The sheet ejecting section 6 includes a sheet ejecting transport path 39 having a generally C-shape opening frontward. The sheet 3 transported from the fixing section 14 passes along the sheet ejecting transport path 39, and is then ejected by a sheet ejecting roller 40 onto a sheet ejecting tray 41 formed on the upper surface of the main body casing 2.

2. Transferring Unit Frame

Figure 2:
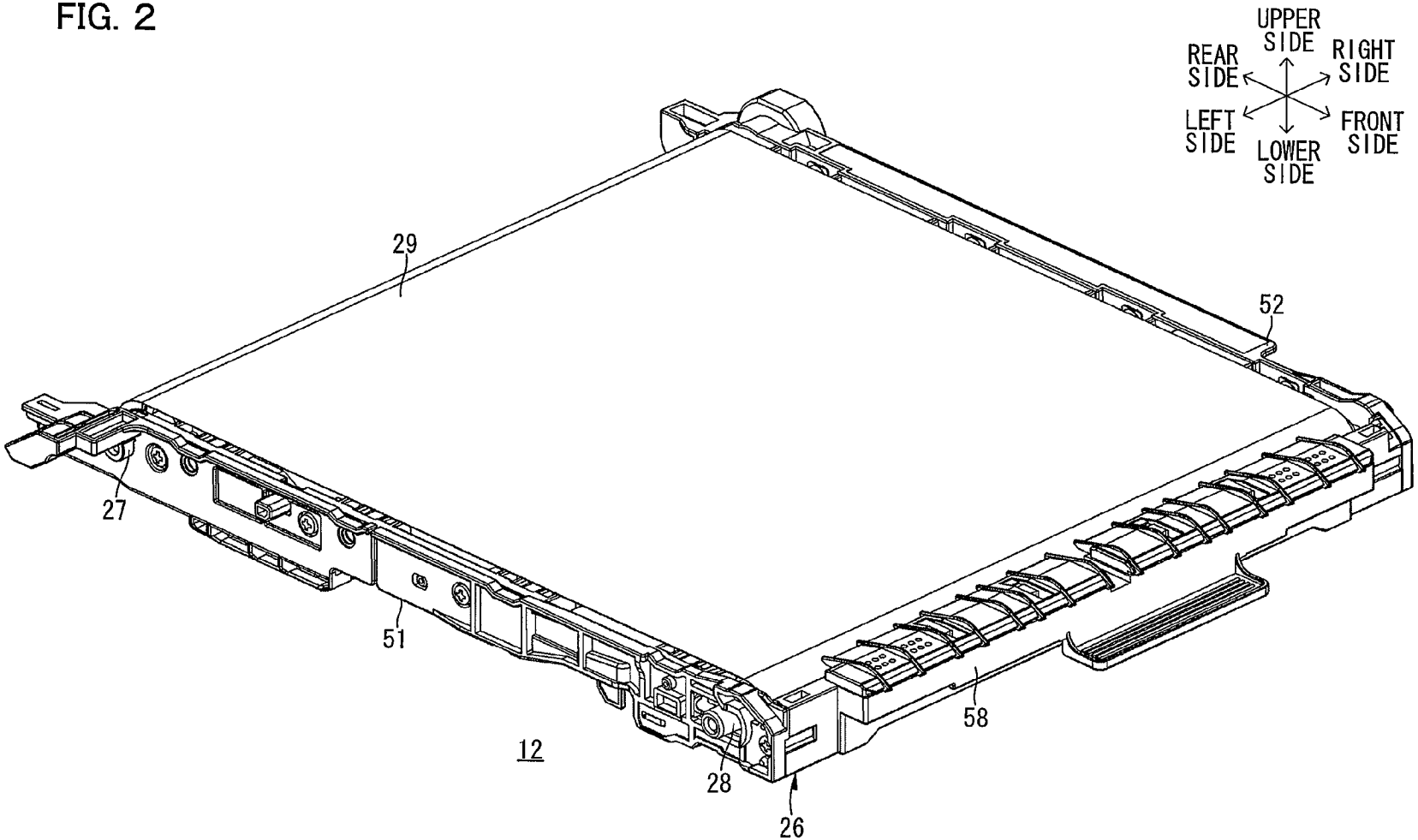
FIG. 2 is a perspective view seen obliquely downwardly from the front left side of a transferring unit shown in FIG. 1.
Figure 3:
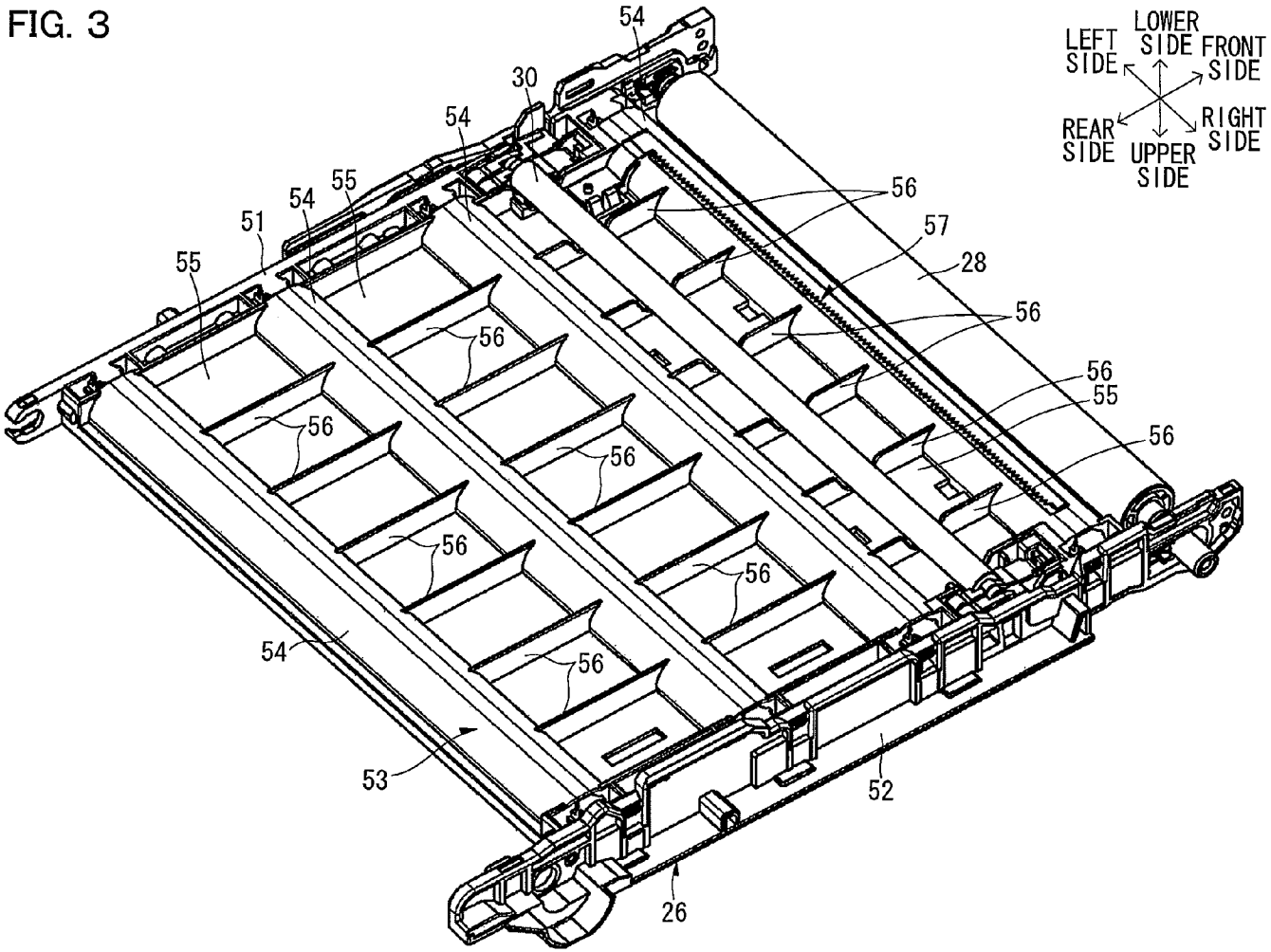
FIG. 3 is a perspective view seen obliquely upwardly from the rear right side of a transferring unit frame shown in FIG. 2.

FIG. 2 is a perspective view seen obliquely downwardly from the front left side of the transferring unit 12 shown in FIG. 1. FIG. 3 is a perspective view seen obliquely upwardly from the rear right side of the transferring unit frame 26 shown in FIG. 2.

The transferring unit frame 26 includes a left side plate 51 and a right side plate 52 opposed in spaced relation to each other in the right and left direction. The left side plate 51 and the right side plate 52 are made of metal, and each extended anteroposteriorly. Both the end portions of the driving roller 27, the driven roller 28, the backup roller 30, and each of the four transfer rollers 31 are rotatably supported on the left side plate 51 and the right side plate 52 respectively.

As shown in FIG. 3, a connecting member 53 made of resin is extended between the left side plate 51 and the right side plate 52. The connecting member 53 integrally includes a transfer-roller accommodating section 54 that encloses each of the transfer rollers 31 from the front, rear, and lower sides, a closed portion 55 that closes a space between the upper end portions of the transfer-roller accommodating section 54, and a plurality of ribs 56 that are extended between the side surfaces of the transfer-roller accommodating section 54.

A discharge member 57 made of an electrically-conductive material, such as stainless steel, is provided on the under surface of the transfer-roller accommodating section 54 on the foremost side, that is, the transfer-roller accommodating section 54 that accommodates the transfer roller 31 opposed to the photosensitive drum 15 of the black processing section 11K. The discharge member 57 is electrically conductively connected with, for example, an electrically conductive member (not shown) provided on the left side plate 51 and/or the right side plate 52, and is grounded via the electrically conductive member.

The backup roller 30 is arranged between the transfer-roller accommodating section 54 positioned on the foremost side and the transfer-roller accommodating section 54 (that accommodates the transfer roller 31 opposed to the photosensitive drum 15 of the yellow processing section 11Y) adjacent thereto. Thus, the discharge member 57 is opposed to; the rear surface of the transport belt 29 between a position where the backup roller 30 and the primary cleaning roller 33 are opposed to each other and the driven roller 28.

As shown in FIG. 2, a front wall 58 made of resin is extended between the respective front end portions of the left side plate 51 and of the right side plate 52. It should be noted that the illustration of the front wall 58 is omitted in FIG. 3.

3. Discharge Member

Figure 4:
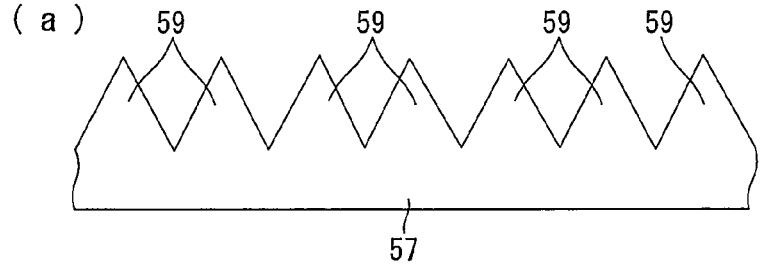
FIG. 4(*a*) is a partial front view of a discharge member shown in FIG. 3, and FIG. 4(*b*) is a side view thereof.
Figure 4:
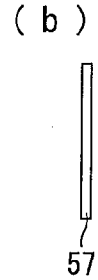

FIG. 4(*a*) is a partial front view of the discharge member 57 shown in FIG. 3, and FIG. 4(*b*) is a side view thereof.

With reference to FIGS. 3 and 4, the discharge member 57 is provided on the under surface of the transfer-roller accommodating section 54 positioned on the foremost side and along the lengthwise direction (right and left direction) thereof. The discharge member 57 has in the right and left direction a length of the width or more of the maximum-sized sheet 3 usable in the color laser printer 1. Further, the discharge member 57 has a height with which the tip end portion thereof does not contact the rear surface of the transport belt 29.

The tip end portion of the discharge member 57 is formed in a sawtooth-like shape by continuously forming a number of edge portions 59 each having a triangular shape in front view. The distal end of each of the edge portions 59 has a radius of curvature of 0.2 mm or less. Particularly, the distal end thereof has preferably a radius of curvature of 0.1 mm or less. The discharge member 57 is placed so that a distance between the distal end of each of the edge portions 59 and the belt is in the range from 1 to 10 mm.

4. Effects

As described above, the backup roller 30 and the primary cleaning roller 33 are opposed to each other while sandwiching the transport belt 29 therebetween. A potential difference produced between the backup roller 30 (transport belt 29) and the primary cleaning roller 33 causes the adherent adhering to the transport belt 29 to be adsorbed onto the primary cleaning roller 33. Thus, the adherent can be advantageously removed from the transport belt 29.

The discharge member 57 for removing charges from the transport belt 29 is arranged between the position where the primary cleaning roller 33 is opposed to the transport belt 29 and a position where the photosensitive drum 15 arranged on the most upstream side (on the foremost side) in the traveling direction of the transport belt 29 is opposed to the transport belt 29. More specifically, the discharge member 57 is opposed to the transport belt 29 between the position where the primary cleaning roller 33 is opposed to the transport belt 29 and a position where the driven roller 28 contacts the transport belt 29.

When the transport belt 29 is electrically charged during cleaning by the primary cleaning roller 33, if a portion where charges are concentrated is produced on the transport belt 29, the charges are discharged from the portion, which may result in uneven charging of the transport belt 29 in some cases. Particularly, with the structure in which the driven roller 28 is grounded, the charges partially escape from the transport belt 29 to the driven roller 28 in the right and left direction, so that uneven charging tends to occur in the transport belt 29. Such uneven charging in the transport belt 29 can locally produce a portion having a small potential difference between the photosensitive drum 15 and the sheet 3 when a toner image is transferred from the photosensitive drum 15 onto the sheet 3. As a result, a so-called white patch where the toner image is not transferred onto the sheet 3 may be produced at the portion.

In the color laser printer 1, the discharge member 57 is opposed to the rear surface of the transport belt 29 between the position where the primary cleaning roller 33 is opposed to the transport belt 29 and the position where the driven roller 28 contact the transport belt 29. Therefore, even if the charge-concentrated portion exists on the transport belt 29, the concentrated charges can be discharged toward the discharge member 57, so that the charges on the transport belt 29 can be removed. This can prevent discharging from the transport belt 29 to the driven roller 28, thereby preventing uneven charging of the transport belt 29 due to such discharging from being produced. As a result, the white patch resulting from the uneven charging of the transport belt 29 can be prevented.

Since the discharge member 57 is grounded, the electric charges captured from the transport belt 29 by the discharge member 57 can be advantageously discharged.

In addition, the discharge member 57 is provided in a non-contact state with the transport belt 29. For this reason, it is possible to prevent the transport belt 29 from being damaged due to contact with the discharge member 57.

Further, the discharge member 57 is attached to the transferring unit frame 26 retaining the transfer roller 31. For this reason, it is not necessary to provide any member for supporting the discharge member 57, separately from the transferring unit frame 26. Thus, the number of component in the apparatus can be reduced. Further, since the transferring unit frame 26 and the transport belt 29 are arranged in proximity to each other, the discharge member 57 and the transport belt 29 can be arranged in proximity to each other by attaching the discharge member 57 to the transferring unit frame 26. As a result, the discharge member 57 can advantageously remove charges from the transport belt 29.

The transport belt 29 has a resistance value of $1.0\times10^{10}$ Ω·cm or more. Higher resistance of the transport belt 29 can produce a larger potential difference between the primary cleaning roller 33 and the transport belt 29, so that the adherent on the transport belt 29 can be advantageously shifted to the primary cleaning roller 33. On the other hand, the higher resistance of the transport belt 29 tends to cause discharging from the transport belt 29 to other members (e.g., the driven roller 28 or a frame). However, since the discharge member 57 is provided, the discharging from the transport belt 29 can be prevented. As a result, uneven charging of the transport belt 29 can be prevented.

Since the discharge member 57 has the edge portions 59 each having a radius of curvature of 0.2 mm or less, charges can be advantageously shifted from the transport belt 29 to the discharge member 57. Therefore, the transport belt 29 can be effectively discharged by the discharge member 57.

In addition, the discharge member 57 has a number of the edge portions 59 in the right and left direction that is a direction intersecting the traveling direction of the transport belt 29. This can uniformly remove charges from the transport belt 29 in the right and left direction. As a result, white patch resulting from the uneven charging of the transport belt 29 can be reliably prevented.

Second Embodiment

Figure 5:
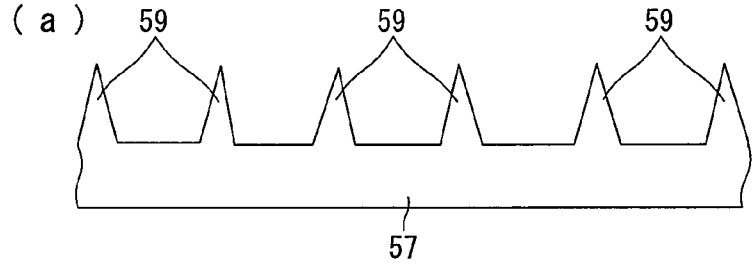
FIG. 5(*a*) is a front view illustrating another structure (a structure in which edge portions are formed in spaced relation) of the discharge member, and FIG. 5(*b*) is a side view thereof.
Figure 5:
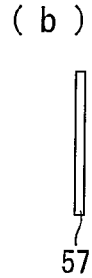

FIG. 5(*a*) is a front view illustrating another structure of the discharge member, and FIG. 5(*b*) is a side view thereof.

As shown in FIG. 5, in the discharge member 57, the edge portions 59 each having a triangular shape in front view do not need to be continuously formed and may be formed in spaced relation in the right and left direction.

Third Embodiment

Figure 6:
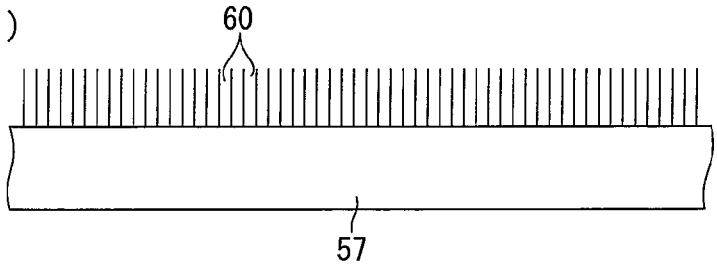
FIG. 6(*a*) is a front view illustrating yet another structure (a structure in which a brush is planted in a tip end portion thereof) of the discharge member, and FIG. 6(*b*) is a side view thereof.
Figure 6:
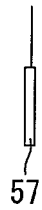

FIG. 6(*a*) is a front view illustrating yet another structure of the discharge member, and FIG. 6(*b*) is a side view thereof.

As shown in FIG. 6, a number of bristles of the brushes 60 may be planted in the tip end portion of the discharge member 57.

Fourth Embodiment

Figure 7:
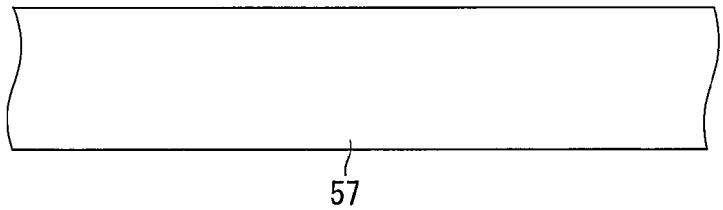
FIG. 7(*a*) is a front view illustrating yet another structure (a structure in which the tip end portion thereof does not have the edge portion or the brush) of the discharge member, and FIG. 7(*b*) is a side view thereof.
Figure 7:
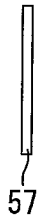

FIG. 7(*a*) is a front view illustrating yet another structure of the discharge member, and FIG. 7(*b*) is a side view thereof.

As shown in FIG. 7, the discharge member 57 may be formed in a thin plate and may not have the edge portions 59 in the tip end portion thereof. However, the belt-side end portion of the discharge member 57 has a radius of curvature of 0.2 mm or less.

Fifth Embodiment

The discharge member 57 may be, for example, opposed to the surface of the transport belt 29 in a non-contact state between the position where the primary cleaning roller 33 is opposed to the transport belt 29 and the position where the photosensitive drum 15 arranged on the foremost side is opposed to the transport belt 29.

Sixth Embodiment

The discharge member 57 may be arranged in a contact state with the surface or the rear surface of the transport belt 29.

Seventh Embodiment

In the color laser printer 1 of a tandem type, the case where the present invention is applied to the transport belt 29 for transporting a sheet 3 has been considered. However, the present invention can also be applied to an intermediate transfer belt in a color laser printer of an intermediate transfer type in which toner images for respective colors are transferred from respective image carriers to an intermediate transfer belt, and thereafter, transferred onto a sheet by one operation.

The embodiments described above are illustrative and explanatory of the invention. The foregoing disclosure is not intended to be precisely followed to limit the present invention. In light of the foregoing description, various modifications and alterations may be made by embodying the invention. The embodiments are selected and described for explaining the essentials and practical application schemes of the present invention which allow those skilled in the art to utilize the present invention in various embodiments and various alterations suitable for anticipated specific use. The scope of the present invention is to be defined by the appended claims and their equivalents.

What is claimed is:

1. A color image forming apparatus comprising:

a belt that travels in a prescribed direction;

a plurality of image carriers arranged in parallel in the prescribed direction, and opposed to the belt and carrying developing agent images of different colors respectively;

a backup roller arranged in opposed relation to the belt;

a cleaning roller arranged in opposed relation to the backup roller with the belt sandwiched therebetween, and adsorbing an adherent to the belt by a potential difference produced between the backup roller and the cleaning roller;

a discharge member opposed to the belt between a position more downstream in the prescribed direction than a position where the cleaning roller is opposed to the belt and a position more upstream in the prescribed direction than a position where the image carrier arranged on the most upstream side in the prescribed direction is opposed to the belt, for discharging the belt;

a first belt roller that contacts the belt between the position where the cleaning roller is opposed to the belt and the position where the image carrier arranged on the most upstream side in the prescribed direction is opposed to the belt; and a second belt roller arranged so as to be spaced away from the first belt roller in the prescribed direction and having the belt wound between the first belt roller and the second belt roller, wherein the discharge member is opposed to the belt between the position where the cleaning roller is opposed to the belt and a position where the first belt roller contacts the belt.

2. The color image forming apparatus according to claim 1, wherein the discharge member has electric conductivity and is provided in a non-contact state with the belt.

3. The color image forming apparatus according to claim 1, comprising:

a plurality of transfer rollers arranged in opposed relation to each of the image carriers with the belt sandwiched therebetween; and a frame retaining the plurality of the transfer rollers, wherein the discharge member is attached to the frame.

4. The color image forming apparatus according to claim 1, wherein the belt has a resistance value of $1.0.\times10^{10}$ Ωcm or more.

5. The color image forming apparatus according to claim 1, wherein the discharge member is grounded.

6. The color image forming apparatus according to claim 1, wherein the discharge member has an edge portion having a radius of curvature of 0.2 mm or less.

7. The color image forming apparatus according to claim 6, wherein the discharge member has a plurality of the edge portions in a direction intersecting the prescribed direction.

8. A color image forming apparatus comprising:

a belt that travels in a prescribed direction;

a plurality of image carriers arranged in parallel in the prescribed direction, and opposed to the belt and carrying developing agent images of different colors respectively;

a cleaning roller opposed to the belt, and adsorbing an adherent to the belt;

a discharge member opposed to the belt between a position more downstream in the prescribed direction than a position where the cleaning roller is opposed to the belt and a position more upstream in the prescribed direction than a position where the image carrier arranged on the most upstream side in the prescribed direction is opposed to the belt, for discharging the belt;

a first belt roller that contacts the belt between the position where the cleaning roller is opposed to the belt and the position where the image carrier arranged on the most upstream side in the prescribed direction is opposed to the belt; and a second belt roller arranged so as to be spaced away from the first belt roller in the prescribed direction and having the belt wound between the first belt roller and the second belt roller, wherein the discharge member is opposed to the belt between the position where the cleaning roller is opposed to the belt and a position where the first belt roller contacts the belt.

* * * * *